US010737515B2

(12) United States Patent
Kobayashi

(10) Patent No.: US 10,737,515 B2
(45) Date of Patent: Aug. 11, 2020

(54) RECORDING DEVICE

(71) Applicant: SEIKO EPSON CORPORATION, Tokyo (JP)

(72) Inventor: Masaki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/351,200

(22) Filed: Mar. 12, 2019

(65) Prior Publication Data

US 2019/0283471 A1 Sep. 19, 2019

(30) Foreign Application Priority Data

Mar. 13, 2018 (JP) ..... 2018-045069

(51) Int. Cl.

| | |
|---|---|
| ***B41J 15/16*** | (2006.01) |
| ***B41J 11/00*** | (2006.01) |
| ***B41J 13/02*** | (2006.01) |
| ***B41J 2/01*** | (2006.01) |
| ***B65H 23/16*** | (2006.01) |

(52) U.S. Cl.

CPC ..... *B41J 15/16* (2013.01); *B41J 2/01* (2013.01); *B41J 11/002* (2013.01); *B41J 13/02* (2013.01); *B41J 15/165* (2013.01); *B65H 23/16* (2013.01)

(58) Field of Classification Search

CPC ... B41J 2/01; B41J 11/002; B41J 13/02; B41J 15/16; B41J 15/165; B65H 18/103; B65H 23/16; B65H 2301/5143; B65H 2301/517; B65H 2404/143; B65H 2801/36

See application file for complete search history.

(56) References Cited

U.S. PATENT DOCUMENTS

| | | | | |
|---|---|---|---|---|
| 9,375,948 | B2 * | 6/2016 | Sasaki | B41J 11/002 |
| 9,855,740 | B2 * | 1/2018 | Nakano | B41J 13/0009 |
| 2014/0368590 | A1 * | 12/2014 | Shima | B41J 11/002 347/102 |
| 2015/0029280 | A1 * | 1/2015 | Sasaki | B41J 11/002 347/102 |
| 2015/0054895 | A1 | 2/2015 | Suzuki et al. | |
| 2015/0202893 | A1 * | 7/2015 | Hara | B41J 11/0095 347/16 |

FOREIGN PATENT DOCUMENTS

| | | |
|---|---|---|
| JP | 2005-161664 A | 6/2005 |
| WO | 2014-119031 A1 | 8/2014 |

* cited by examiner

*Primary Examiner* — Anh T Vo
(74) *Attorney, Agent, or Firm* — Workman Nydegger

(57) ABSTRACT

Provided is a recording device including a conveying portion configured to convey a medium in a conveying direction, a recording unit configured to record on the medium conveyed in the conveying direction, a guiding portion disposed further downstream in the conveying direction than the recording portion and configured to change the conveying direction while guiding conveyance of the medium, a winding portion disposed further downstream in the conveying direction than the guiding portion and configured to wind the medium, and a heating portion configured to heat the medium disposed between the recording portion and the winding portion in the conveying direction, heat the guiding portion, and heat the winding portion.

3 Claims, 4 Drawing Sheets

RECORDING DEVICE

BACKGROUND

1. Technical Field

The present invention relates to a recording device.

2. Related Art

Various recording devices have been used. Of these recording devices, there is a recording device that includes a winding portion that winds a medium on which recording is performed. The recording device including the winding portion may facilitate drying by heating the medium before winding the medium in order to prevent a recorded image formed on the medium from being damaged, for example, due to the winding operation performed before an ink in a form of liquid dries.

As an example of the recording device that can heat a medium before winding the medium, WO 2014/119031 discloses a printer (recording device) that includes a recording head that discharges ink onto the recording medium (medium), a heater (heating portion) for curing the ink, a winding shaft (winding portion) that winds the recording medium on which recording has been done, and a tension bar (guiding portion) that changes the conveying direction of the recording medium while guiding conveyance of the recording medium.

Heating may cause expansion or contraction depending on the type of medium used. In addition, in the case where droplets are discharged to form an image on the medium, the degree of expansion or contraction of the medium may be uneven depending, for example, on the degree of volatility of volatile compounds of the droplets in association with heating of the medium. Thus, in the case of the known recording device as described in WO 2014/119031, the temperature of the medium suddenly changes due to the medium on which recording has been done being heated and the temperature of the medium returning to the room temperature (the temperature of the environment where the recording device is disposed) before the medium is wound. In addition, this sudden change in the temperature of the medium may create wrinkling or cockling on the medium, which may lead to imperfect winding (such as winding in a wrinkled state, or an occurrence of misaligned winding in the wound medium) at the time of winding the medium.

It should be noted that JP-A-2005-161664 discloses drying means that include a heater that can heat winding means (a winding portion) at a portion immediately before the recording paper (medium) is wound. Even with such a configuration, the temperature of the medium suddenly changes from the time of recording to the time when the medium is wound (immediately before the medium is wound), and hence, the medium expands or contracts, which may lead to imperfect winding. In addition, even in the case where the configuration (in other words, the configuration for heating the winding shaft) described in JP-A-2005-161664 is applied to the printer disclosed in WO 2014/119031, the temperature of the recording medium suddenly drops (for example, the temperature suddenly drops in association with contact with the tension bar) in a wide area extending from the upstream side of the tension bar where the heater is formed to the downstream side of the tension bar where the winding shaft is formed, or the temperature suddenly rises immediately before the medium is wound, and hence, imperfect winding is expected to occur.

SUMMARY

Thus, an object of the invention is to prevent an occurrence of imperfect winding at the time of winding a medium on which recording has been done.

A recording device according to a first aspect of the invention, which is provided to solve the problem described above, includes a conveying portion configured to convey a medium in a conveying direction, a recording unit configured to record on the medium conveyed in the conveying direction, a guiding portion that is disposed further downstream in the conveying direction than the recording portion and that is configured to change the conveying direction while guiding conveyance of the medium, a winding portion that is disposed further downstream in the conveying direction than the guiding portion and that is configured to wind the medium, and a heating portion configured to heat the medium disposed between the recording portion and the winding portion in the conveying direction, heat the guiding portion, and heat the winding portion.

According to this aspect, there is provided the heating portion that heats the medium disposed between the recording unit and the winding portion in the conveying direction, heats the guiding portion, and heats the winding portion. For this reason, it is possible to prevent a sudden change in temperature of the medium after the recording unit records and before it is wound by the winding portion. Thus, it is possible to prevent imperfect winding at the time of winding a medium on which recording has been done.

In the first aspect, a recording device according to a second aspect of the invention includes a heating controlling unit configured to control the heating portion, in which the heating portion includes a first heating portion configured to heat the medium disposed between the recording portion and the guiding portion in the conveying direction, and heat the guiding portion, and a second heating portion configured to heat the medium disposed between the guiding portion and the winding portion in the conveying direction, and heat the winding portion, and the heating controlling unit controls the second heating portion such that a temperature of the medium heated by the second heating portion is lower than or equal to the temperature of the medium heated by the first heating portion.

According to this aspect, control is performed so that the temperature of the medium heated by the second heating portion is lower than or equal to the temperature of the medium heated by the first heating portion. Although the wound medium eventually reaches a room temperature, by causing the temperature of the medium heated by the second heating portion to be lower than or equal to the temperature of the medium heated by the first heating portion, it is possible to prevent a sudden change in temperature of the wound medium, and hence, it is possible to particularly effectively prevent imperfect winding.

In the second aspect, a recording device according to a third aspect of the invention includes a winding controlling unit configured to control the winding portion, in which the second heating portion is a non-contact heating portion configured to heat the medium and the winding portion in a non-contact manner, the winding controlling unit is configured to select between a first winding mode and a second winding mode and execute a selected mode, the first winding mode being a mode in which a non-recording surface side of the medium is wound to be inward, the second winding mode being a mode in which a recording surface side of the medium is wound to be inward, the non-recording surface side being a side on which no recording is performed, the recording surface side being a side on which recording is performed, and the heating controlling unit is configured to change controlling of the second heating portion depending on whether the first winding mode is executed or the second winding mode is executed.

Positions of the medium between the guiding portion and the winding portion in the conveying direction differ between the first winding mode and the second winding mode. Thus, the distance from the second heating portion to the medium may vary, and hence, a preferable heating temperature at the second heating portion may vary. According to the present aspect, the second heating portion is controlled differently depending on whether the first winding mode is executed or the second winding mode is executed, and hence, it is possible to cause the second heating portion to have an appropriate heating condition regardless of whether the first winding mode is executed or the second winding mode is executed. For example, of the first winding mode and the second winding mode, the heating temperature is reduced in the case of a mode in which the space between the second heating portion and the medium is narrow, and the heating temperature is raised in the case of a mode in which the space between the second heating portion and the medium is wide. This effectively enables the second heating portion to have a preferable heating temperature.

In the second aspect or third aspect described above, there is provided a recording device according to a fourth aspect of the invention, in which the recording portion includes a recording head configured to discharge a droplet on a recording surface of the medium on which recording is performed, and the heating controlling unit increases output of the second heating portion over an increase in an amount of the droplet discharged on the recording surface.

According to this aspect, the heating portion is controlled according to the amount of the droplet discharged on the recording surface. Thus, it is possible to reduce the difference in temperature from the room temperature, for example, by increasing output of the second heating portion (raising the heating temperature) in the case where the amount of the droplet is large to effectively volatilize the volatile components of the droplet, whereas reducing output of the second heating portion (reducing the heating temperature) in the case where the amount of the droplet is small. This makes it possible to effectively prevent imperfect winding.

BRIEF DESCRIPTION OF THE DRAWINGS

The invention will be described with reference to the accompanying drawings, wherein like numbers reference like elements.

DESCRIPTION OF EXEMPLARY EMBODIMENTS

Example 1

Figure 1:
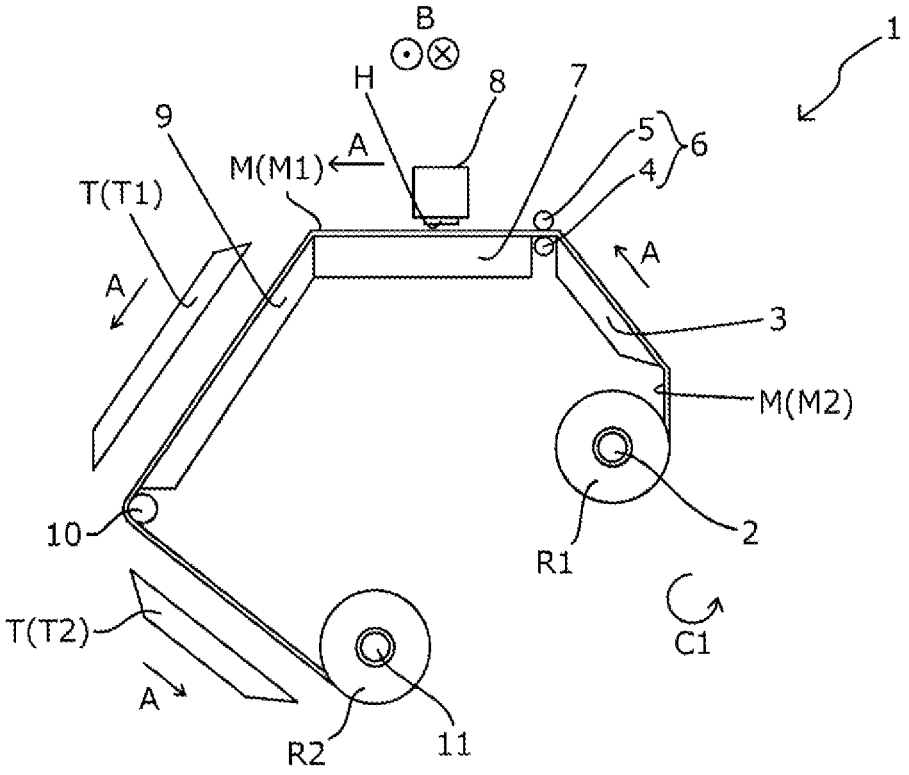
FIG. 1 is a side view schematically illustrating a recording device according to Example 1 of the invention.
Figure 2:
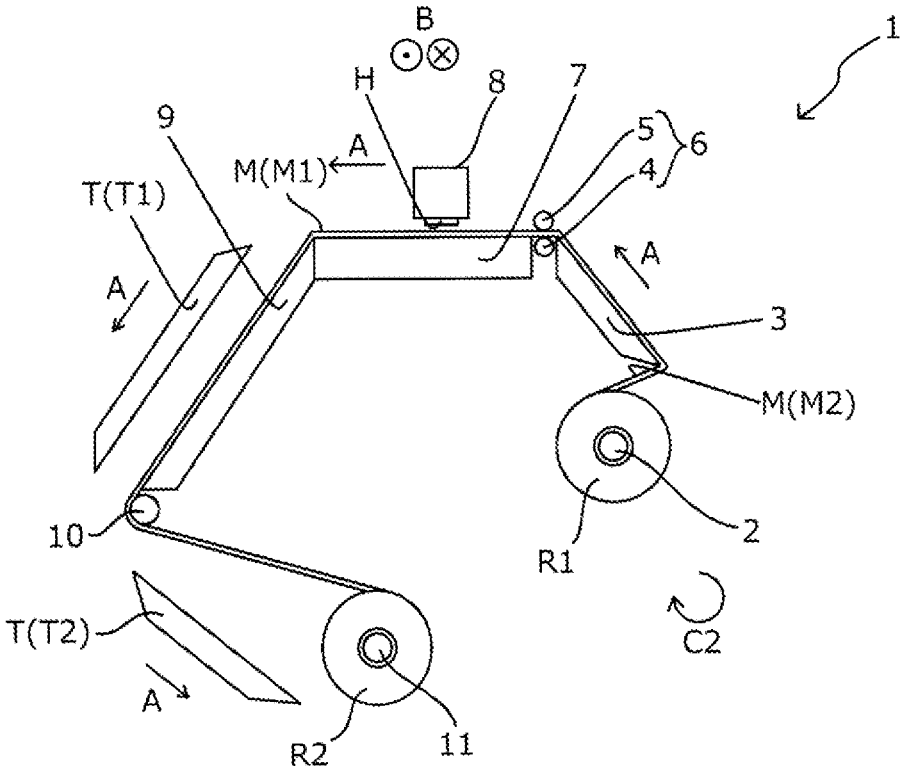
FIG. 2 is a side view schematically illustrating the recording device according to Example 1 of the invention.
Figure 3:
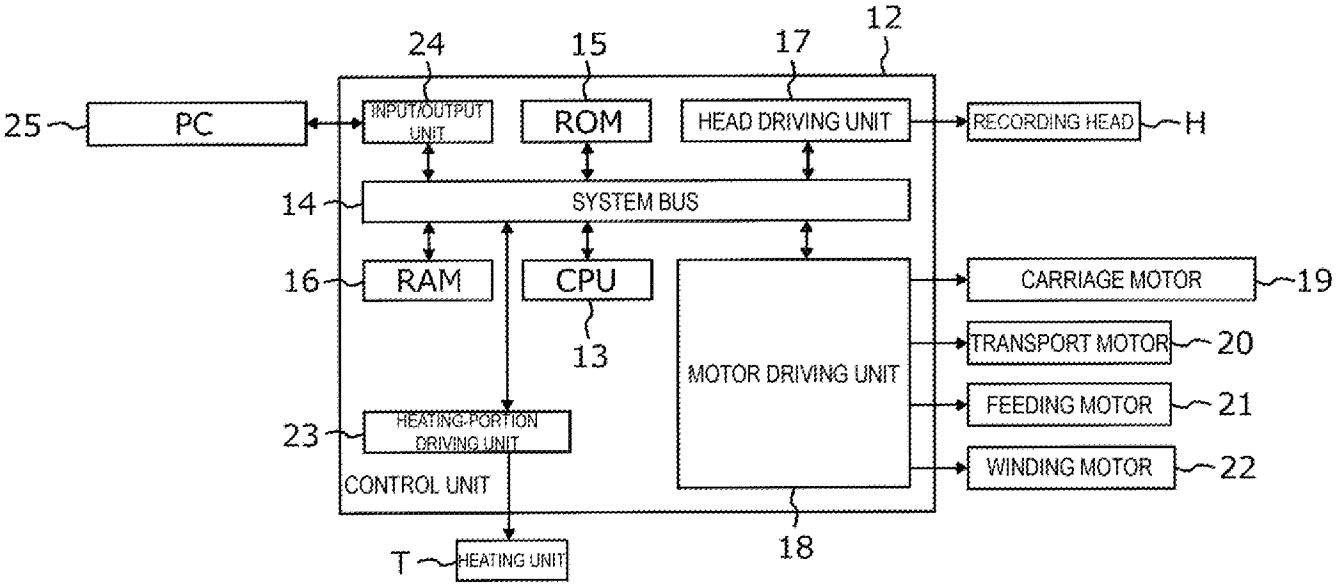
FIG. 3 is a block diagram illustrating the recording device according to Example 1 of the invention.

From FIG. 1 to FIG. 3.

Hereinafter, a recording device 1 according to Example 1 will be described in detail with reference to the appended drawings.

First, the outline of the recording device 1 according to the example will be described.

FIGS. 1 and 2 are side views each schematically illustrating the recording device 1 according to the example. Of these drawings, FIG. 1 illustrates a state where a roll body R1 obtained by winding a medium M with a recording surface M1, on which recording is performed (on which an image is formed), being on the outside is used to form a roll body R2 by performing winding with the recording surface M1 being on the outside. On the other hand, FIG. 2 illustrates a state where the roll body R1 wound with the recording surface M1 being disposed on the inside is used to form the roll body R2 wound with the recording surface M1 being disposed on the inside.

The recording device 1 according to the example includes a setting portion 2 that sets the roll body R1 to be able to feed the medium M for recording. Note that the recording device 1 according to the example uses a roll-type target recording medium as the medium M. However, the invention is not limited to such a recording device using a roll-type target recording medium. For example, it may be possible to use a folding-type target recording medium and the like, provided that the medium M on which recording has been done can be wound.

In the case of using the roll body R1 wound with the recording surface M1 being outside, the recording device 1 according to the example rotates the setting portion 2 in a rotating direction C1 (see FIG. 1) when the medium M is conveyed in the conveying direction A. On the other hand, in the case of using the roll body R1 wound with the recording surface M1 being inside, the recording device 1 according to the example rotates the setting portion 2 in a rotating direction C2 (see FIG. 2) when the medium M is conveyed in the conveying direction A.

In addition, the recording device 1 according to this example includes a conveying roller pair 6 serving as a conveying portion for conveying the medium M in the conveying direction, the conveying roller pair being disposed between a first platen 3 and a second platen 7. The conveying roller pair 6 includes a driving roller 4 for driving (rotating) using a drive force of a conveying motor 27 (see FIG. 3), and a driven roller 5 that rotates in association with rotation of the driving roller 4. In addition, the setting portion 2 rotates in the rotating direction C1 or the rotating direction C2. The conveying roller pair 6 rotates (the driving roller 4 rotates in the rotating direction C1). A winding portion 11, which will be described later, rotates in the rotating direction C1 or the rotating direction C2. Thus, the medium M is conveyed in the conveying direction A.

Furthermore, the recording device 1 according to the example reciprocatingly scans a carriage 8 serving as the recording portion in a scanning direction B that intersects with the conveying direction A of the medium M, to perform recording. The carriage 8 includes a recording head H that discharges ink (droplet) on the recording surface M1. The ink is discharged from the recording head H while the carriage 8 is being reciprocatingly scanned in the scanning direction B to form (record) an image on the medium M.

With the configuration described above, the recording head H can discharge the ink from a nozzle, not illustrated, on the conveyed medium M while reciprocatingly moving in the scanning direction B that intersects with the conveying direction A, to perform recording (form an image). With the recording head H having such a configuration, the recording device 1 according to the example repeats the conveying operation for conveying the medium M in the conveying direction A by a predetermined conveying amount, and a discharging operation for discharging ink while the recording head H is moving in the scanning direction B in a state where the medium M is at rest. This repeating operation enables a desired image to be formed on the medium M.

It should be noted that the recording device 1 according to the example has a configuration in which the carriage 8 (recording head H) is moved reciprocatingly to perform recording. However, it may be possible to employ a recording device that includes a so-called line head including a plurality of nozzles for discharging ink, the plurality of nozzles being provided in a direction that intersects with the conveying direction A.

Here, the "line head" represents a recording head provided such that a region including the nozzles formed in the intersecting direction that intersects with the conveying direction A of the medium M is configured, for example, to be able to cover the entirety of that intersecting direction of the medium M, and is used in a recording device that forms an image by fixing one of the recording head and the medium M and moving the other. Note that the area including the nozzles in the intersecting direction of the line head may not be configured to be able to cover the entirety of the intersecting direction for all types of media M that can be used in the recording device.

Furthermore, the recording device 1 according to the example includes a second platen 7 disposed in an area facing the carriage 8, the second platen serving as a supporting portion for the medium M, and also includes a first platen 3 disposed upstream of the second platen 7 in the conveying direction A of the medium M, and a third platen 9 disposed downstream of the second platen 7 in the conveying direction A of the medium M. In addition, the first platen 3, the second platen 7, and the third platen 9 of the recording device 1 according to the example are each provided with a heating portion, not illustrated, including an electrical heating wire and used to evaporate part of volatile components of ink discharged on the medium M. However, the invention is not limited to the configuration in which the first platen 3, the second platen 7, and the third platen 9 each include the heating portion.

Furthermore, a tension bar 10 serving to adjust tension of the medium M when this medium M is wound is provided on the downstream side of the third platen 9 in the conveying direction A. Here, the tension bar 10 also serves as a guiding portion that sets a changed position at the time of changing the conveying direction A of the medium M in side view as illustrated in FIGS. 1 and 2, while guiding the medium M. Note that the recording device 1 according to the example includes the tension bar 10 serving to adjust tension of the medium M. However, in a case where there is provided a guiding portion that changes the conveying direction A of the medium M while guiding the conveyance of the medium M, the guiding portion need not serve to adjust tension of the medium M.

A winding portion 11 that can wind the medium M is provided downstream of the tension bar 10 in the conveying direction A. Note that, in the recording device 1 according to the example, the winding portion 11 rotates in the rotating direction C1 (see FIG. 1) in the case where the medium M is wound with the recording surface M1 being outward to form the roll body R2. On the other hand, in the recording device 1 according to the example, the winding portion 11 rotates in the rotating direction C2 (see FIG. 2) in the case where the medium M is wound with the recording surface M1 being inward to form the roll body R2.

A first heating portion T1 serving as a heating portion T capable of heating the medium M is provided at a position further downstream than the carriage 8 and further upstream than the tension bar 10 in the conveying direction A, the position facing the third platen 9. The first heating portion T1 is configured to be able to heat the medium M located at a position where the medium is supported by the third platen 9 and the tension bar 10, and also to be able to heat the tension bar 10.

A second heating portion T2 serving as a heating portion T capable of heating the medium M is provided at a position further downstream than the tension bar 10 and further upstream than the winding portion 11 in the conveying direction A. The second heating portion T2 is configured to be able to heat the medium M located between the tension bar 10 and the winding portion 11 in the conveying direction A, and also heat the winding portion 11.

Note that both of the first heating portion T1 and the second heating portion T2 according to the example are infrared heaters that can emit electromagnetic waves (infrared rays) onto the medium M. However, there is no particular limitation applied to the configuration and the arrangement of the heating portion T. For example, at least one of the first heating portion T1 and the second heating portion T2 may be a heating portion that is not an infrared heater. The heating portion that is not the infrared heater includes, for example, an electrical heating wire and a tube heater as a contact-type heating portion. In addition to using an infrared heater as a single unit, it may be possible to blow heated air or combine the heated air with the infrared heater as a non-contact heating portion. Furthermore, it may be possible to combine the contact-type heating portion with the non-contact heating portion to use the combination as one heating portion.

Next, the electrical configuration of the recording device 1 according to the example will be described.

FIG. 3 is a block diagram illustrating the recording device 1 according to the example.

The controlling unit 12 includes a CPU 13 that manages control of the entire recording device 1. The CPU 13 is connected through a system bus 14 to a ROM 15 that stores, for example, various types of control programs to be implemented by the CPU 13, and a RAM 16 that can temporarily store data.

Furthermore, the CPU 13 is connected through the system bus 14 to a head driving unit 17 for driving the recording head H (for discharging the ink).

Furthermore, the CPU 13 is connected through the system bus 14 to a motor driving unit 18 that is connected to a carriage motor 19, a conveying motor 20, a feeding motor 21, and a winding motor 22.

Here, the carriage motor 19 is a motor for moving, in the scanning direction B, the carriage 8 having the recording head H mounted thereon. In addition, the conveying motor 20 is a motor for driving the driving roller 4 that forms the conveying roller pair 6. Moreover, the feeding motor 21 is a rotating mechanism for the setting portion 2, and is a motor for driving the setting portion 2 to feed the medium M to the conveying roller pair 6. Yet moreover, the winding motor 22 is a driving motor for rotating the winding portion 11.

Furthermore, the CPU 13 is connected through the system bus 14 to a heating-portion driving unit 23 that is connected to the heating portion T. Note that the heating-portion driving unit 23 is configured to be able to drive a heating portion, not illustrated, provided to the first platen 3, the second platen 7, and the third platen 9, in addition to the first heating portion T1 and the second heating portion T2.

Furthermore, the CPU 13 is connected through the system bus 14 to an input/output unit 24 that is connected to a PC 25 for receiving and transmitting data such as recording data and signals.

With the configuration described above, the controlling unit 12 according to the example plays the roles of a recording controlling unit that controls recording (discharging ink from the recording head H) using the carriage 8, a scanning controlling unit that controls scanning of the carriage 8, a feeding controlling unit that controls feeding of the medium M, a conveying controlling unit that controls conveyance of the medium M, a winding controlling unit that controls winding of the medium M, and a heating controlling unit that controls heating by the heating portion T.

Here, a brief summary is given below. The recording device 1 according to the example includes the conveying roller pair 6 serving as a conveying portion that conveys the medium M in the conveying direction A, and the carriage 8 serving as the recording portion that records on the medium M conveyed in the conveying direction A. In addition, there is also provided the tension bar 10 disposed further downstream than the carriage 8 in the conveying direction A and serving as the guiding portion that changes the conveying direction A while guiding conveyance of the medium M, and the winding portion 11 disposed further downstream than the tension bar 10 in the conveying direction A and winding the medium M.

Furthermore, the recording device 1 according to the example includes the heating portion T that heats the medium M disposed between the carriage 8 and the winding portion 11 in the conveying direction A, and also heats the tension bar 10 and the winding portion 11.

Thus, the recording device 1 according to the example has a configuration that can prevent a sudden change in temperature of the medium M after recording has been performed by the carriage 8 and before it is wound by the winding portion 11. In particular, by not only heating the medium M but also heating the tension bar 10 and the winding portion 11, it is possible to prevent heat from moving from the medium M to the tension bar 10 or winding portion 11. Thus, the recording device 1 according to the example can prevent imperfect winding at the time of winding the medium M on which recording has been done.

Note that "heating the medium M disposed between the carriage 8 and the winding portion 11 in the conveying direction A" is not limited to a configuration in which heating is performed to the medium M at all the positions between carriage 8 and the winding portion 11 in the conveying direction A. A configuration is included in which there is some area between the carriage 8 and the winding portion 11 in the conveying direction A where heating is not performed to the medium M. In other words, the configuration of the first heating portion T1 is not limited to the configuration in which the medium M disposed between the carriage 8 and the tension bar 10 in the conveying direction A is heated at all positions. In addition, the configuration of the second heating portion T2 is not limited to the configuration in which the medium M disposed between the tension bar 10 and the winding portion 11 in the conveying direction A is heated at all positions.

In addition, the recording device 1 according to the example is configured to be able to heat the medium M not only between the carriage 8 and the winding portion 11 in the conveying direction A (after recording is performed and before the medium M is wound), but also configured to be able to heat before recording, using a not-illustrated heating portion provided to the first platen 3, and during recording, in other words, between the setting portion 2 and the carriage 8 in the conveying direction A, using a not-illustrated heating portion provided to the second platen 7. Furthermore, in the area where the third platen 9 and the first heating portion T1 face each other, configuration is made such that the medium M can be heated by both of the heating portion of the third platen 9 and the first heating portion T1. Thus, the recording device 1 according to the example is configured to be able to particularly effectively heat the medium M according to the type of the medium M and the like. However, the invention is not limited to a configuration of the heating portion such as that of the recording device 1 according to the example.

Furthermore, as described above, the controlling unit 12 according to the example serves as the heating controlling unit that controls the heating portion T.

The heating portion T has the first heating portion T1 and the second heating portion T2 as illustrated in FIGS. 1 and 2. As described above, the first heating portion T1 heats the medium M disposed between the carriage 8 and the tension bar 10 in the conveying direction A, and also heats the tension bar 10. In addition, the second heating portion T2 heats the medium M located between the tension bar 10 and the winding portion 11 in the conveying direction A, and also heats the winding portion 11.

Here, the controlling unit 12 can control the second heating portion T2 such that temperatures of the medium M heated by the second heating portion T2 are lower than or equal to temperatures of the medium M heated by the first heating portion T1. At this time, the temperature of the medium M heated by the first heating portion T1 and the temperature of the medium M heated by the second heating portion T2 are detected using a not-illustrated infrared sensor or the like. In other words, control is performed such that the temperature of the medium M on the downstream side in the conveying direction A relative to the tension bar 10 is lower than the temperature of the medium M on the upstream side in the conveying direction A relative to the tension bar 10. Here, the controlling unit 12 controls the second heating portion T2 based on temperatures of the hottest portion of the temperature distribution detected using an infrared sensor on the surface of the medium M heated by the first heating portion T1. In the case where the amount of conveyance of the medium M per unit of time in the conveying direction A (namely, the speed of conveyance) is larger and the temperature distribution significantly changes towards the conveying direction A on the surface of the medium M, the second heating portion T2 may be controlled based on the average temperature of the temperature distribution on the surface of the medium M heated by the first heating portion T1, the average temperature being detected at a predetermined time. With this configuration, it is possible to reduce the effect of a change in temperature distribution due to change in the temperature distribution toward the conveying direction A.

Note that the example describes that the controlling unit 12 controls the second heating portion T2 using, as a reference, temperatures of the medium M heated by the first heating portion T1. However, the invention is not limited to this. For example, it may be possible that, after the second heating portion T2 is controlled using, as a reference, temperatures of the medium M heated by the first heating portion T1, the result of detection of temperatures of the medium M heated by the second heating portion T2 is fed back to the controlling unit 12, and the first heating portion T1 is controlled such that temperatures of the medium M heated by the second heating portion T2 are lower than or equal to temperatures of the medium M heated by the first heating portion T1. Furthermore, in addition to the control based on temperatures of the surface of the medium M, it may be possible to control the first heating portion and the second heating portion based on the amount of energy output of radiation energy radiated from the first heating portion T1 and radiation energy radiated from the second heating portion T2. In this case, it is preferable to observe the radiation energy, for example, using a not-illustrated infrared sensor.

The medium M wound as the roll body R2 eventually reaches room temperature (temperature of the environment where the recording device 1 is placed). By causing the temperature of the medium M heated by the second heating portion T2 to be lower than or equal to the temperature of the medium M heated by the first heating portion T1, it is possible to prevent a sudden change in temperature of the medium M that has been wound. In addition, by causing the temperature of the medium M heated by the second heating portion T2 to be lower than or equal to the temperature of the medium M heated by the first heating portion T1, it is possible to prevent the medium M from being excessively heated. For example, in the case where materials including cellulose fiber or pulp fiber are used for the medium M, water molecules contained in the medium M reduce due to heating, and the fibers may be likely to shrink in the diameter direction of the fibers. In other words, the medium M shrinks. Even in such a case, the example can prevent the medium M from being excessively heated, and hence, can prevent occurrence of wrinkles associated with shrinkage of the medium M and causing imperfect winding. Thus, the recording device 1 according to the example has a configuration that can particularly effectively prevent imperfect winding.

Note that the recording device 1 according to the example has a configuration in which the heating temperature at the first heating portion T1 and the heating temperature at the second heating portion T2 are inputted into the controlling unit 12 through the PC 25, so that the heating temperature at the first heating portion T1 and the heating temperature at the second heating portion T2 can be set. However, the invention is not limited to such a configuration. It may be possible to employ, for example, a configuration in which the controlling unit 12 automatically sets each of the heating temperatures depending on the type of the medium M used or the like such that the temperature of the medium M heated by the second heating portion T2 is lower than or equal to the temperature of the medium M heated by the first heating portion T1.

Furthermore, as described above, the controlling unit 12 according to the example serves as the winding controlling unit that controls the winding portion 11.

Here, the recording device 1 according to the example has a configuration in which a first winding mode (see FIG. 1) and a second winding mode (see FIG. 2) can be selected through control by the controlling unit 12 to execute the selected mode, the first winding mode being a mode in which a non-recording surface M2 side of the medium M is disposed on the inner side of the winding, the second winding mode being a mode in which a recording surface M1 side of the medium M is disposed on the inner side of winding, the non-recording surface M2 side being a side on which no recording is performed, the recording surface M1 side being a side on which recording is performed.

In addition, the controlling unit 12 is configured to be able to change controlling (change the heating temperature) of the second heating portion T2 depending on whether the first winding mode is executed or the second winding mode is executed.

As can be clearly understood by comparing FIGS. 1 and 2, positions of the medium M from the tension bar 10 to the winding portion 11 in the conveying direction A differ between the first winding mode (see FIG. 1) and the second winding mode (see FIG. 2). Thus, the distance (space) from the second heating portion T2 to the medium M may vary, and hence, preferable heating temperatures at the second heating portion T2 may vary. However, with the recording device 1 according to the example, the second heating portion T2 is controlled differently depending on whether the first winding mode is executed or the second winding mode is executed, and hence, it is possible to cause the second heating portion T2 to have a preferable heating condition regardless of whether the first winding mode is executed or the second winding mode is executed.

Note that there is no particular limitation applied to a method for "changing controlling of the second heating portion T2". In addition to changing heating temperatures as with the recording device 1 according to the example, it may be possible to change the timing for on and off switching of the second heating portion T2, change the distance from the second heating portion to a member to be heated (the medium M or the winding portion 11), or change the angle of emission of electromagnetic waves (infrared rays) emitted from the second heating portion.

Furthermore, as described above, in the recording device 1 according to the example, both of the first heating portion T1 and the second heating portion T2 are infrared heaters. In other words, both of the first heating portion T1 and the second heating portion T2 are non-contact heating portions. In addition, as described above, positions of the medium M from the tension bar 10 to the winding portion 11 in the conveying direction A differ between the first winding mode (see FIG. 1) and the second winding mode (see FIG. 2). Thus, the distance (space) from the second heating portion T2 to the medium M varies. Thus, as described above, the controlling unit 12 can change controlling of the second heating portion T2 depending on whether the first winding mode is executed or the second winding mode is executed.

In other words, in the case of the recording device 1 according to the example, the second heating portion T2 is a non-contact heating portion that heats the medium M and the winding portion 11 in a non-contact manner, and the controlling unit 12 can change controlling of the second heating portion T2 depending on the space between the second heating portion T2 and the medium M for each of the first winding mode and the second winding mode.

Thus, of the first winding mode and the second winding mode, the recording device 1 according to the example reduces the heating temperature in the case of a mode (the first winding mode in the example) in which the space between the second heating portion T2 and the medium M is narrow, and raises the heating temperature in the case of a mode (the second winding mode in the example) in which the space between the second heating portion T2 and the medium M is large. This effectively enables the second heating portion to have a preferable heating temperature.

Furthermore, the recording device 1 according to the example includes a not-illustrated sensor that detects the winding diameter of the roll body R2, and can change controlling of the second heating portion T2 depending on the winding diameter detected by the sensor for each of the first winding mode and the second winding mode. This control is performed to deal with a case where the space between the second heating portion T2 and the medium M becomes narrower over an increase in the winding diameter in the first winding mode whereas the space between the second heating portion T2 and the medium M becomes wider over an increase in the winding diameter in the second winding mode. Thus, more specifically, the heating temperature is reduced in the case where the winding diameter increases in the first winding mode, and the heating temperature is raised in the case where the winding diameter increases in the second winding mode.

Furthermore, as described above, the carriage 8 includes the recording head H that discharges a droplet (ink) on the recording surface M1 of the medium M on which recording is performed.

In addition, the controlling unit 12 can control the heating portion T according to the amount of droplet discharged on the recording surface M1.

As for specific controlling of the heating portion T according to the amount of droplet discharged on the recording surface M1, for example, output of the second heating portion T2 is caused to increase (raise the heating temperature) to effectively volatilize volatile components of the droplet in the case where the amount of droplet is large, and output of the second heating portion T2 is caused to decrease (reduce the heating temperature) in the case where the amount of droplet is small. This makes it possible to reduce the temperature difference relative to the room temperature. Thus, the recording device 1 according to the example can effectively prevent imperfect winding. At this time, output of the first heating portion T1 may be increased or decreased according to increase or decrease in output of the second heating portion T2.

Example 2

FIG. 4

Next, a recording device 1 according to Example 2 will be described.

Figure 4:
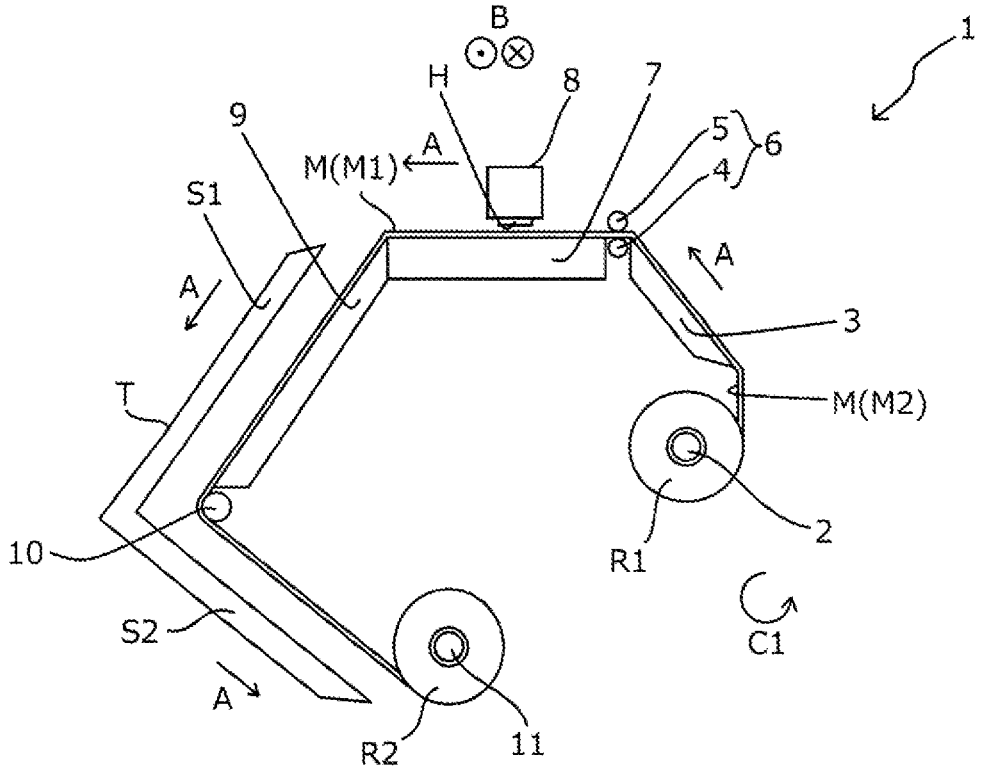
FIG. 4 is a side view schematically illustrating a recording device according to Example 2 of the invention.

FIG. 4 is a side view schematically illustrating the recording device 1 according to the example, and is a diagram corresponding to FIG. 1 concerning the recording device 1 according to Example 1. Like numbers designate identical or corresponding component elements in Example 1, described above, and detailed description for such component elements are omitted.

Here, the recording device 1 according to the example has a configuration similar to that of the recording device 1 according to Example 1 except for the configuration of the heating portion T.

In the case of the recording device 1 according to Example 1, the heating portion T is configured such that the first heating portion T1 that heats between the carriage 8 and the tension bar 10 is provided separately from the second heating portion T2 that heats between the tension bar 10 and the winding portion 11, as illustrated in FIGS. 1 and 2. On the other hand, as illustrated in FIG. 4, the heating portion T of the recording device 1 according to the example is configured such that one heating portion T can heat between the carriage 8 and the winding portion 11.

Furthermore, the heating portion T according to the example is configured such that in the area S1, heating is performed between the carriage 8 and the tension bar 10 (including heating the tension bar 10), and in the area S2, heating is performed between the tension bar 10 and the winding portion 11 (including heating the winding portion 11). As described above, the heating portion T may be configured with a plurality of heating portions, or may be configured with one heating portion.

Note that the invention is not intended to be limited to the aforementioned examples, and many variations are possible within the scope of the invention as described in the appended claims. It goes without saying that such variations also fall within the scope of the invention. For example, the heating portion may be provided at the winding portion 11 or the tension bar 10 or the like. However, in the case where the heating portion is provided at the winding portion 11, it is preferable to employ a motor brush or the like for the electrode so that this winding portion 11 can rotate.

This application claims priority under 35 U.S.C. § 119 to Japanese Patent Application No. 2018-045069, filed Mar. 13, 2018. The entire disclosure of Japanese Patent Application No. 2018-045069 is hereby incorporated herein by reference.

What is claimed is:

1. A recording device comprising:

a conveying portion configured to convey a medium in a conveying direction;

a recording unit configured to record on the medium conveyed in the conveying direction;

a guiding portion disposed downstream of the recording portion in the conveying direction and configured to change the conveying direction while guiding conveyance of the medium;

a winding portion disposed downstream of the guiding portion in the conveying direction and configured to wind the medium;

a heating portion configured to heat the medium disposed between the recording portion and the winding portion in the conveying direction, heat the guiding portion, and heat the winding portion; and a heating control unit configured to control the heating portion, wherein, the heat portion includes:

a first heating portion configured to heat the medium disposed between the recording portion and the guiding portion in the conveying direction, and heat the guiding portion, and a second heating portion configured to heat the medium disposed between the guiding portion and the winding portion in the conveying direction, and heat the winding portion, and the heating controlling unit controls the second heating portion so that a temperature of the medium heated by the second heating portion is lower than or equal to the temperature of the medium heated by the first heating portion.

2. The recording device according to claim 1 comprising:

a winding controlling unit configured to control the winding portion, wherein the second heating portion is a non-contact heating portion configured to heat the medium and the winding portion in a non-contact manner, the winding controlling unit is configured to select between a first winding mode and a second winding mode and execute the selected mode, the first winding mode being a mode in which a non-recording surface side of the medium is wound to be inward, the second winding mode being a mode in which a recording surface side of the medium is wound to be inward, the non-recording surface side being a side on which recording is not performed, the recording surface side being a side on which recording is performed, and the heating controlling unit is configured to change controlling of the second heating portion depending on whether the first winding mode is executed, or the second winding mode is executed.

3. The recording device according to claim 1 wherein the recording portion includes a recording head configured to discharge a droplet on a recording surface of the medium on which recording is performed, and the heating controlling unit increases output of the second heating portion over an increase in an amount of the droplet discharged on the recording surface.

* * * * *